United States Patent [19]

Gauthier

[11] 4,343,156

[45] Aug. 10, 1982

[54] RE-HEATING CRYOGENIC FLUIDS

[75] Inventor: Pierre Gauthier, Fresnes, France

[73] Assignee: L'Air Liquide, Societe Anonyme pour l'Etude et l'Exploitation des Procedes Georges Claude, Paris, France

[21] Appl. No.: 237,736

[22] Filed: Feb. 24, 1981

[30] Foreign Application Priority Data

Feb. 29, 1980 [FR] France ..... 80 04509

[51] Int. Cl.[3] ..... F17C 7/02

[52] U.S. Cl. ..... 62/52; 165/115

[58] Field of Search ..... 62/52, 53; 165/115

[56] References Cited

U.S. PATENT DOCUMENTS

| | | | |
|---|---|---|---|
| 2,348,601 | 5/1944 | Buschow et al. | 165/115 |
| 4,226,605 | 10/1980 | Van Don | 62/52 |

FOREIGN PATENT DOCUMENTS

| | | | |
|---|---|---|---|
| 2052154 | 4/1972 | Fed. Rep. of Germany . | |
| 2903079 | 8/1979 | Fed. Rep. of Germany | 62/52 |
| 1393641 | 8/1970 | France . | |
| 4832064 | 2/1968 | Japan . | |
| 55-10165 | 1/1980 | Japan | 62/52 |
| 911847 | 11/1962 | United Kingdom . | |

OTHER PUBLICATIONS

Patents Abstracts of Japan, vol. 3, No. 32, Mar. 17, 1979, p. 89, C40 & JP-A-54 7403, (Osaka Gas) (01-2-0-1979).

Patents Abstracts of Japan, vol. 2, No. 41, Mar. 17, 1978, p. 4728, C77 & JP-A-52-144006, (Osaka Gas) (Dec. 1977).

Advances in Instrumentation, vol. 33, Oct. 4, 1978, T. J. Hanna: "Operating Experiences with Running Film & Steam-Type Vaporizers", pp. 43-54.

*Primary Examiner*—Ronald C. Capossela

*Attorney, Agent, or Firm*—Young & Thompson

[57] ABSTRACT

This invention relates to the reheating of a cold cryogenic fluid by heat exchange with a warm liquid, commonly water. The cold cryogenic fluid first flows into a descending tube and then into a rising tube whereas the water trickles along the tubes and from an upper supply, as far as a base manifold. The invention is particularly applicable to the reheating and revaporization of liquified natural gas.

11 Claims, 9 Drawing Figures

RE-HEATING CRYOGENIC FLUIDS

BACKGROUND OF THE INVENTION

The present invention relates to a method of and apparatus for reheating cryogenic fluids by heat exchange with heat-carrying fluids having a freezing point which exceeds the temperature of the cryogenic fluid prior to its final reheating.

It is applicable in particular to the reheating of liquified natural gas by means of water available in great quantity such as natural water sources for instance, rivers, lakes and oceans.

It is an object of the invention to be able to make use of water or another fluid at a comparatively low temperature whilst avoiding or minimising any risk of freezing the heat-carrying fluid.

A variety of solutions has already been proposed, none of which however have enabled this result to be obtained.

For example, French Patent Specification No. 70 26,212 discloses a process for reheating natural gas by exchange in counterflow in a plurality of vertical tubes arranged in parallel relationship, the natural gas always flowing in an upward direction within the tubes and the heat-carrying water trickling naturally by force of gravity along the outside of these tubes which are provided with longitudinal fins. In order that the heat exchange may be optimised, that is to say to maximise the heat flow whilst preventing freezing of the water on the outer circumference of the tubes, an ever diminishing internal tube cross-section is provided for passage of the natural gas which results in successive increases in the speed of the natural gas flowing in the tubes. These successive reductions in the passage cross-section were established by insertion of an internal lining formed by a tapered tube of varying cross-section, but the technology for achieving this is rather complex and consequently the cost is high if not prohibitive for most purposes.

Japanese Pat. No. 54 7403 discloses the reheating of natural gas by initial exchange in co-directional flow between the natural gas flowing upwards from below in a tubular cluster and the water flowing upwards from below in a shell or casing in a forced flow, then by an exchange in counterflow between the gas flowing downwards from above in another cluster or nest of tubes and the water flowing upwards from below in the corresponding casing. This procedure is also quite complex and leads to considerable deterioration of the casings in particular, in the case of accidental freezing of the reheating water.

Furthermore Japanese Pat. No. 52 144, 006 discloses a reheating plant comprising a first section for exchange in counterflow between the natural gas flowing upwards from below in a first plurality of tubes and the water trickling naturally on the outside, then a second section equally for exchange in counterflow, the natural gas flowing upwards from below in a second plurality of tubes and the water trickling naturally on the outside, with the feature that the second plurality of tubes opposes a smaller passage cross-section to the natural gas than the first plurality. This system also fails to accomplish the object of the present invention.

SUMMARY OF THE INVENTION

The invention consists in a method of reheating a cryogenic fluid such as liquid natural gas by means of heat exchange with a heat-carrying fluid such as water the freezing point of which is higher than the temperature of said cryogenic fluid prior to its final reheating, said cryogenic fluid being ducted into a plurality of vertical tubular elements comprising fins and connected in series, initially in co-directional flow with said heat-carrying fluid flowing at the circumference of said tubular elements and then in counterflow with said heat-carrying fluid, wherein said heat-carrying fluid is caused by the force of gravity to trickle along said tubular elements and each tubular element which is the farthest upflow is supplied with cryogenic fluid at its upper extremity.

The advantages of the invention may be explained in the following manner:

On the one hand, the presence of a first cocurrent flow exchange is decisive because of the limitation of the heat flow intended to prevent external freezing. As a matter of fact, if the temperature of the water at the inlet that is to say at the top extremity of the leading element, amounts to +4° C. and to +2° C. at the outlet for example, that is to say at the lower extremity of this same tubular element, the rate of flow of natural gas liquified at a temperature of −160° C. which may enter a tube operating in cocurrent flow is more than twice as great as that which may enter this same tube operating in counterflow.

The presence of at least a second heat exchange in counterflow also plays a very decisive role due to the small temperature difference between the natural gas emerging from the second element and the water heating this latter. As a matter of fact, if the temperature of the water at the upper extremity, that is to say at the top outlet of this second element is +2° C., and +4° C. at the bottom inlet, the length of this second element operating in counterflow is 30% less than that which would be needed for an analogous operation in cocurrent flow.

On the other hand, since the critical temperature of natural gas is commonly close to −60° C., its weight per unit volume close to this temperature varies rapidly with the temperature, even under a pressure exceeding the critical pressure (6 kgs/m$^3$/° C. under 75 bars). However, the speed of flow of the natural gas in the second tubular element still remains necessarily low to prevent external freezing. In these circumstances, a downward flow of the natural gas would result in flow disturbances caused by the inopportune action of the force of gravity engendering irreversible thermodynamic actions. On the contrary and in accordance with the invention, an upward flow in the second element leads to a natural stratification in accordance with mass per unit volume and with the temperature of the natural gas, which consequently does not bring about any disturbance in the flow. Given that the intermediate temperature between the first and second tubular elements is close to the critical temperature, it is preferable as a result to make provision for an upward flow of the natural gas in the second tubular element to ensure final reheating of the natural gas without undesirable irreversible actions which would have to be balanced out by an appreciable increase of the exchange surface.

The invention also consists in apparatus for reheating a cryogenic fluid by heat exchange with a warm liquid, of the kind comprising tubular heat exchange elements of substantially vertical extension, with means for distributing a trickling liquid at the upper ends of said elements wherein said tubular elements comprise at least one module having at least one first upflow or leading element joined by a connection at its lower end to the lower end of at least one second or downflow tubular element, and means for supplying cryogenic fluid to the upper end of each said downflow passage element.

BRIEF DESCRIPTION OF THE DRAWINGS

In order that the invention may be more clearly understood, reference will now be made to the accompanying drawings which show certain embodiments thereof by way of example and in which.

DETAILED DESCRIPTION OF PREFERRED EMBODIMENTS

Figure 1:
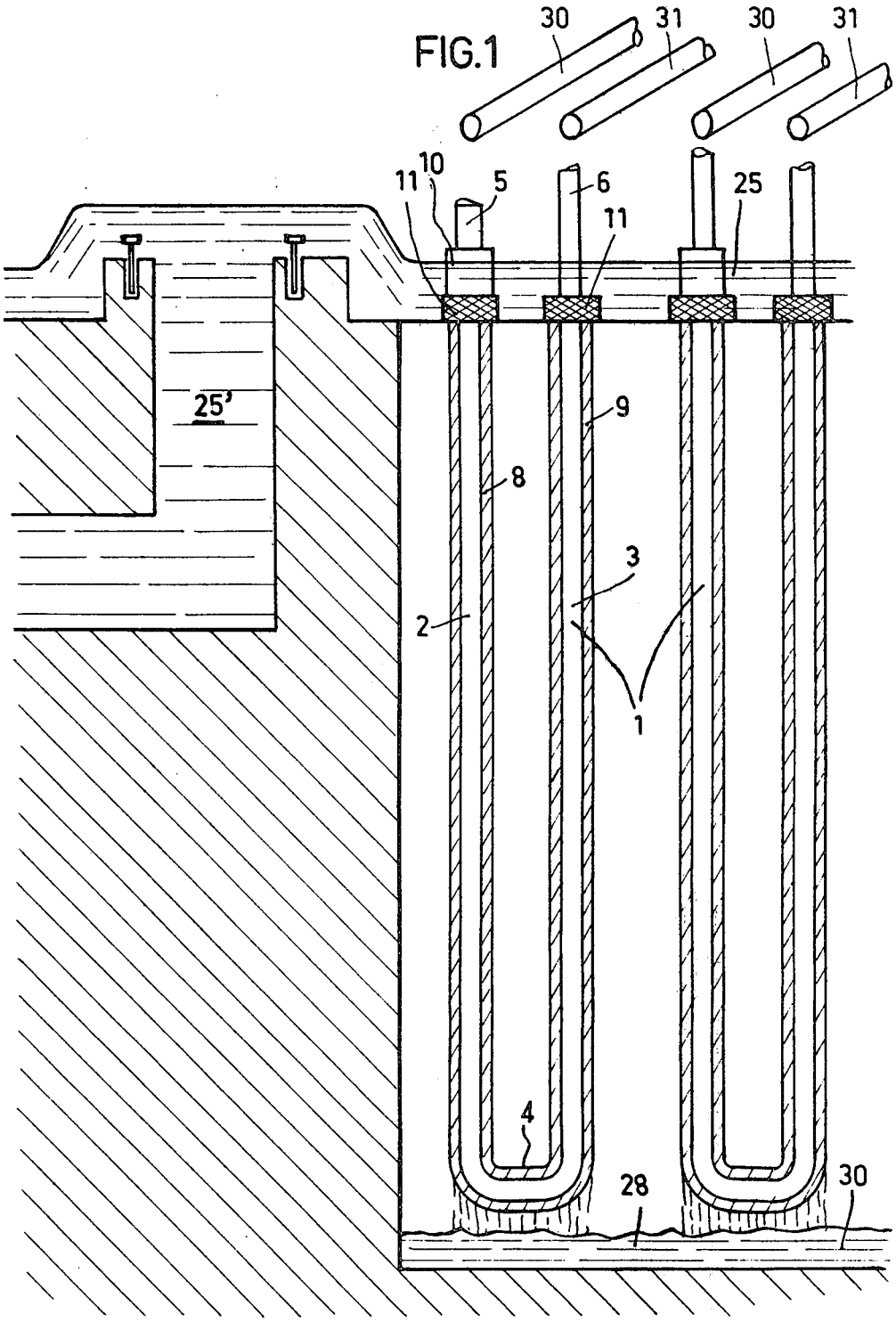
FIG. 1 is a partial view in vertical cross-section of a plant for the reheating of low-temperature fluid in accordance with the invention.
Figure 2:
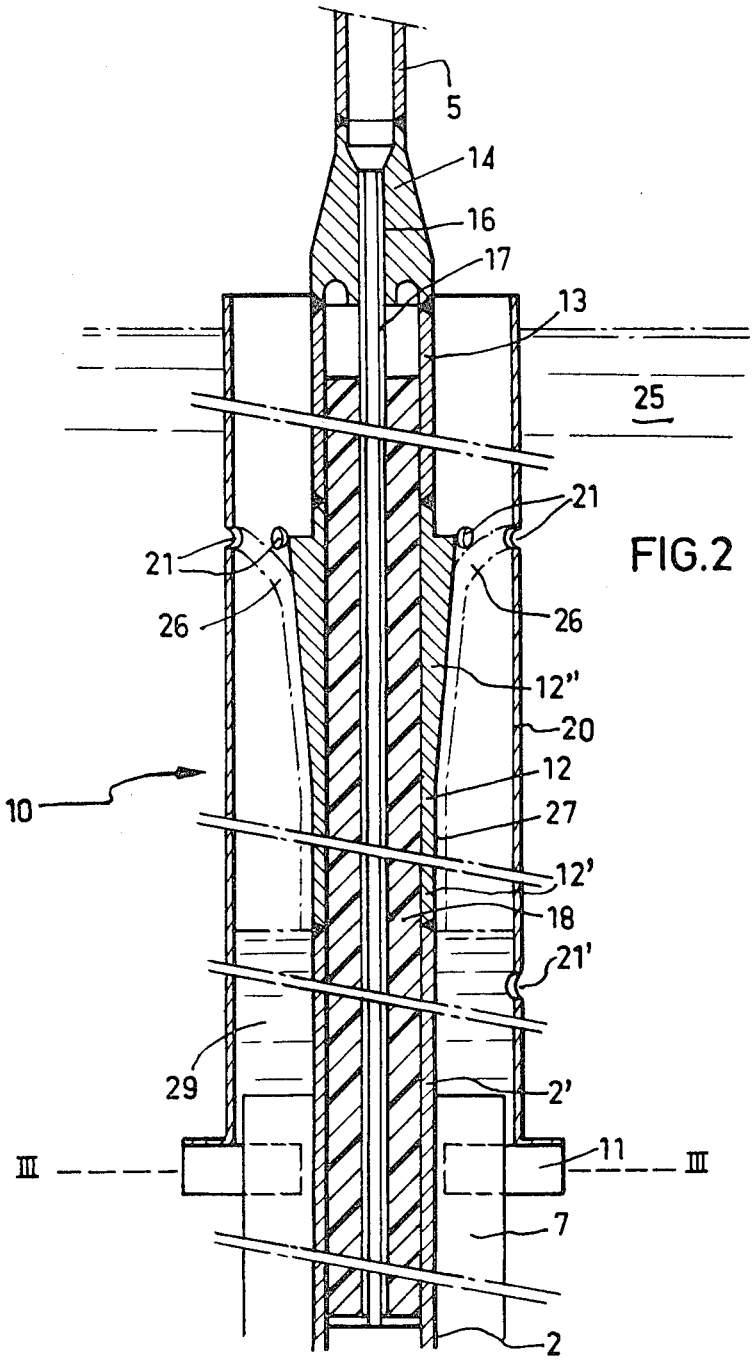
FIG. 2 shows a detail on an enlarged scale, of a part of FIG. 1.
Figure 3:
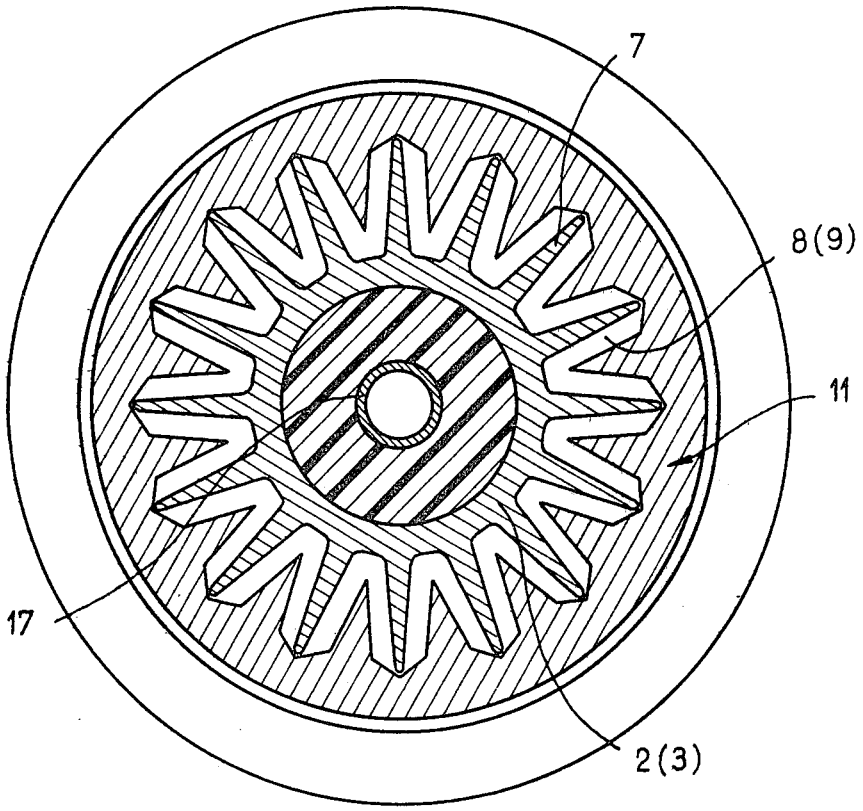
FIG. 3 is an enlarged scale view in cross-section along the line III—III of FIG. 2, and FIGS. 4, 5, 6, 7, 8 and 9 show modified forms of a plant in accordance with the invention.

Referring now to the drawings and firstly to FIGS. 1 to 3, the apparatus depicted therein comprises a plurality of reheating tubes 1 forming heat exchange passages, made of aluminum, each comprising a "downflow" or leading tubular element 2 and an "upflow" tubular element 3, which are connected by a bottom elbow 4. The leading tubular element 2 is connected to a pipe 5 leading to a supply of cryogenic or low-temperature fluid which is to be reheated via a coupling box 10, whereas the tubular element 3 is connected directly to a pipe 6 for withdrawal of reheated fluid: the tubular elements 2 and 3 are suspended in such manner that they extend in substantially vertical manner, and flows of reheating fluid in the form of sheets 8 and 9 which are formed beforehand by top distribution devices 11 trickle all around and along these tubular elements which comprise external fins 7.

In this case, the coupling box 10 (see FIG. 2) has welded to it in extension of the leading element 2, a jacket tube 12 having a constant wall thickness in a low section 12′ and increasing radially in a middle portion 12″, with a constant internal diameter; at the upper end, this jacket tube 12 is extended as far as 13 up to an end 14 for connection of the pipe 5 for the low-temperature fluid. All these elements are made of aluminum so that they may conveniently be welded to each other and to the tubular heat exchange element 1. The end 14 has an internal bore 16 of small diameter into which is welded a pipe element 17 which leads into the greater width of the leading tubular element 2. A heat insulation material 18 is situated between the pipe element 17 on the one hand and the jacket tube 13–12 and the top part of the tubular element 2, on the other hand. The assembly which has been described is housed within a distribution well 20 comprising a ring of perforations 21. This well 20 is secured on the distribution device 11 sheathing the tubular element 2 and its fins 7 with a small spacing, and the perforations 21 are situated at the top level of the portion 12″ of increasing wall thickness. In practice, and as will be apparent from the drawings, the trickling heating fluid which is intended to flow in sheets such as 8 and 9 along the "downflow" tubular elements 2 and "upflow" tubular elements 3, comes from a supply of liquid 25 which, for its part is supplied by a source 25′.

In operation, the trickling heating fluid is transferred into a lower portion of the distribution well 20 in the form of a plurality of liquid jets or streams 26 coming from the supply 25 and formed starting from the perforations 21. Due to the system described, the cryogenic fluid flowing within the pipe 5 and the tube 17 to reach the leading tubular element 2 is radially insulted from the outside by the insulating material 18. Moreover, the substantial longitudinal frigorific flow which is generated substantially on the "downflow" side, to the level of the end 14 and travels downwards and flows down along the jacket tube 13–12 towards the tubular element 2, is substantially deflected outwards radially at the point of the jacket tube 12 having a wall thickness increasing gradually towards the upflow side. As a matter of fact, in the middle portion 12″ which has a considerable wall thickness of the jacket tube 12, at that point, the longitudinal frigorific flow undergoes a maximum transfer to the water which is present in the form of jets 26 in free and rapid gravitic flow. This maximum radial and outward heat transfer action derives on the one hand from the provision at the level of the jets 26 of a substantial excess wall thickness of the portion 12″ of the jacket tube 12 which provides an increased heat conduction in the radial direction, and on the other hand from a rapid flow of the water in free fall, which has the result of raising the heat exchange factor to its maximum value. This system thus allows of a deflection towards the jets of liquid 26 of a substantial part of the longitudinally flowing frigorific flow, which commensurately reduces the residual frigorific flow continuing its longitudinal travel within the section 12′ of lesser wall thickness and primarily towards the top section 2′ of the leading element 2 which is immersed in a separate supply 29 of water for distribution which is of substantially still nature and thus has a low heat exchange factor with respect to the wall of the tubular element 2. Without the arrangement described above, what would be observed would be the arrival of a substantial frigorific flow travelling in the wall longitudinally at the level of the part 2′ of the tubular element 2 surrounded by a stock of still water 29 which could not fail to cause harmful superficial freezing of the water at the level of the part 2′ since these freezing actions could affect the total stock of water 29 by extending radially, and could thus obstruct the heat exchange of the tube 2–3. On the contrary, due to the arrangement described, control may be exercised in a very precise manner of the heat flow reaching the part 2′ of the leading element 2 since this heat flow is the sum of a longitudinally propagated residual heat flow and of a radially propagated heat flow which is small for its part, in view of the interpositioning of the insulating material 18. Moreover, it is possible by contrast in particular cases to effect a slight increase in the heat exchange coefficient between the part 2′ of the tubular element 2 and the supply of water 29 by imparting to the latter a degree of convection movement due to the presence of clearing holes 21′ formed at a low level within the distributing wall 20, thus promoting a definite complementary intake of water coming direct from the principal supply 25.

As has been hereinbefore explained, the trickling water is formed into a trickling sheet on the outer finned surface of the downflow tubular element 2 and cools gradually as far as the lower extremity of this tubular element 2, at which the trickling water is then drawn off at 30 together moreover with that provided by the trickling in counterflow on the "upflow" tubular element 3. It may be observed that the risk of freezing of the trickling water is reduced distinctly at the level of this tubular element 3, as the fluid which is being heated whilst flowing in the tubes 1 has had its temperature raised until it is close to that of the trickling liquid, so that the discharge of the heated fluid from the tubular element 3 may be performed without application of a coupling box such as described with reference to FIG. 2, by means of an uncomplicated discharge pipe 6, whilst the distribution device 11 however evidently allows of forming a uniform trickling sheet 9 as illustrated in FIG. 3.

Instead of making use of a heating tube whose intake end receives the unprocessed fluid which is to be reheated and whose discharge end delivers the fluid at the required reheat temperature (or more specifically, a plurality of such tubes arranged in parallel and connected direct to inlet manifolds 30 and discharge manifolds 31), it is possible to organize the tubular elements in a particular number of combinations.

Figure 4:
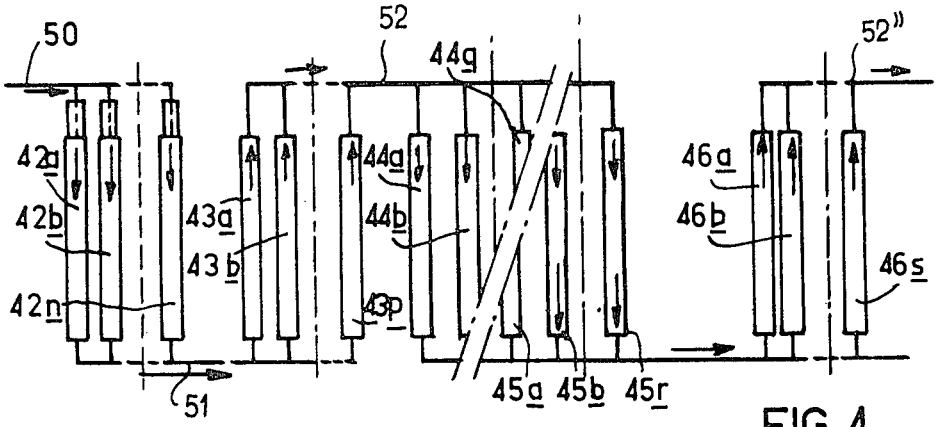

Referring to FIG. 4, it will be apparent that a plurality of tubular elements 42*a*, 42*b*, . . . 42*n*, has all its tubes connected between an upper distribution manifold or header 50 and a lower connecting manifold 51 feeding another plurality 43*a*, 43*b*, . . . 43*n* of tubular elements, thereby forming a first multi-tubular module the upper end of which is connected via a manifold 52 to a second multi-tubular module formed by another plurality of tubular elements 44*a*, 44*b*, . . . 44*n*, the final module comprising a plurality of tubular elements 45*a*, 45*b*, . . . 45*r* and a plurality of tubular elements 46*a*, 46*b*, . . . 46*s*, feeding the heated liquid into a final manifold 52″.

Figure 5:
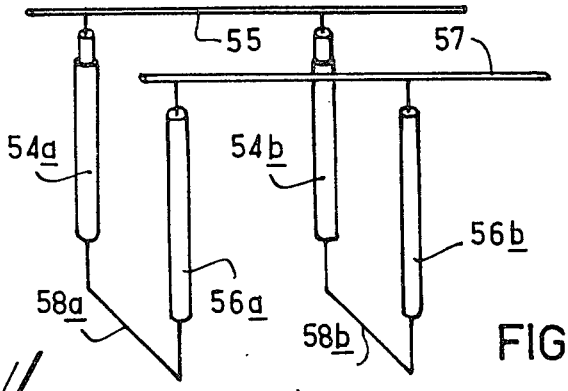

According to FIG. 5, mono-tubular modules such as those described with reference to FIG. 1, each comprising a downflow tubular element (54*a*, 54*b*, . . . etc. . . . ), are supplied at their top extremity via a common feed manifold 55 and are joined by separate connections 58*a*, 58*b*, . . . to an upflow tubular element (56*a*, 56*b*, . . . etc. . . . ), the latter themselves being connected at their upper extremities to a common discharge manifold 57.

Figure 6:
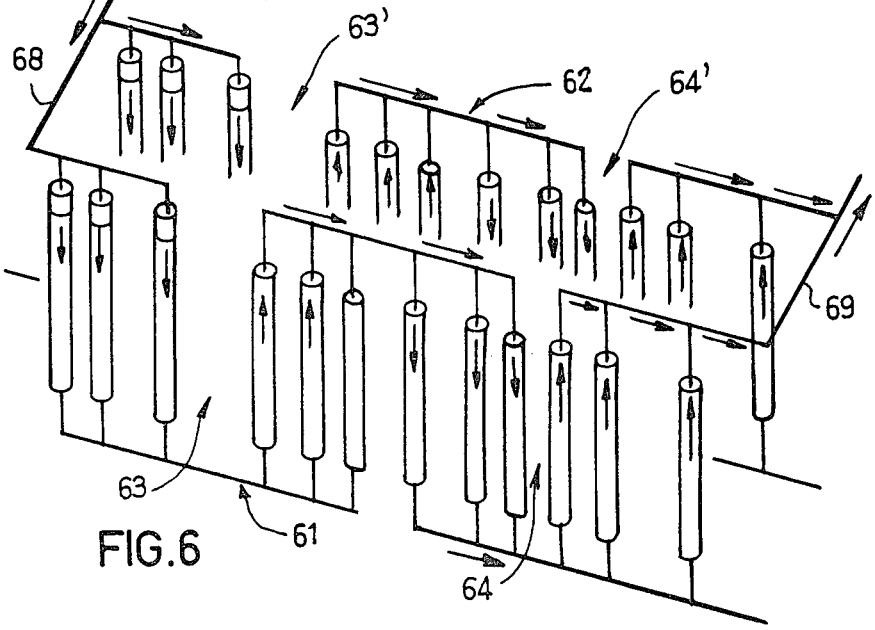

According to FIG. 6, several lines 61 and 62, such as those depicted in FIG. 4, that is to say each incorporating several multi-tubular modules 63, 64 . . . 63′, 64′ . . . in series, are connected in parallel between a principal intake manifold 68 and a principal discharge manifold 69.

Figure 7:
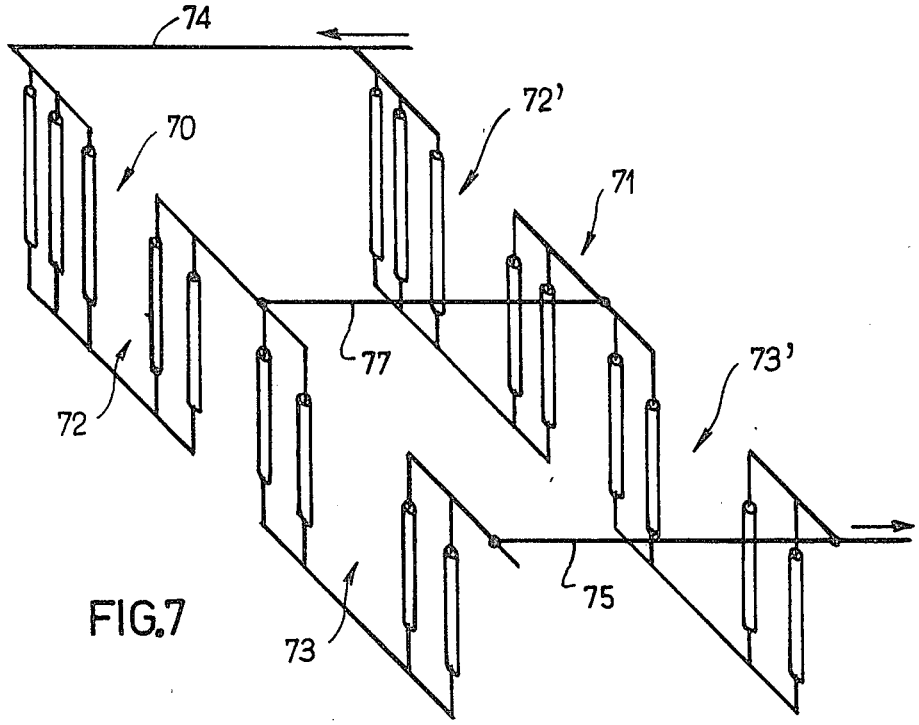

According to FIG. 7, several lines 70, 71, each comprising several multi-tubular modules 72, 73 . . . 72′, 73′ . . ., are not only connected between a principal supply manifold 74 and a principal discharge manifold 75, but intermediate balancing manifolds connect the homologous modules of several lines in parallel.

Figure 8:
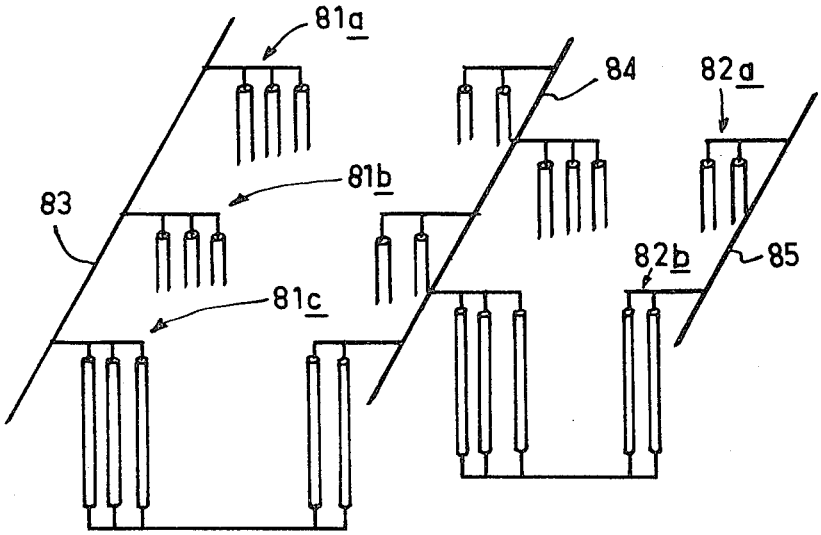

According to FIG. 8, a cluster of tubular elements is formed by a first set of lines 81*a*, 81*b*, 81*c* (three for example) comprising a multi-tubular module (or several multi-tubular modules in series) between a feed manifold 83 and an intermediate manifold 84 which supplies a second set of lines 82*a* and 82*b* (two for example) between this intermediate manifold 84 and the final discharge manifold 85.

Figure 9:
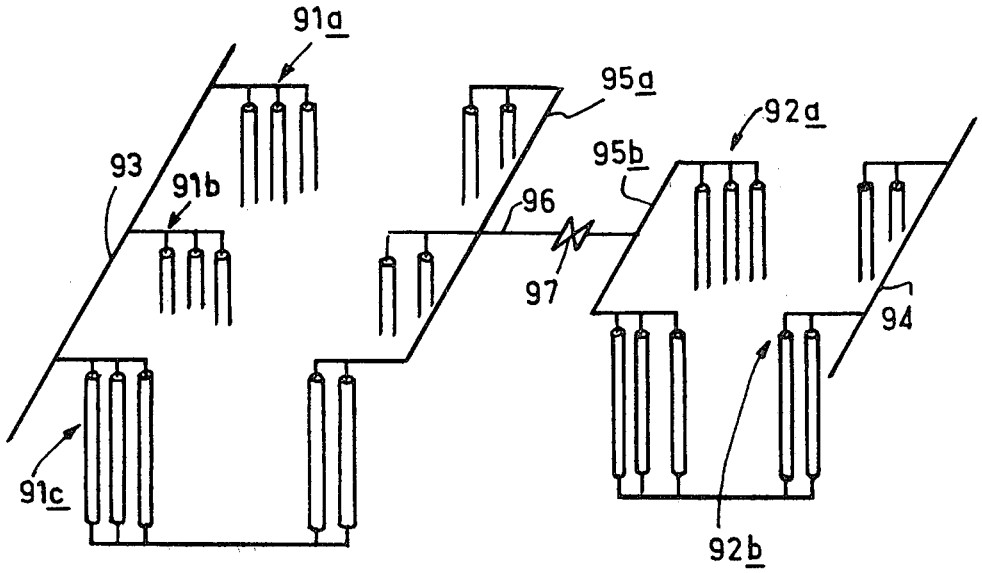

According to FIG. 9, a first group comprising a plurality of lines 91*a*, 91*b*, 91*c* (three for example) supplied via a feed manifold 93 and drained via a discharge manifold 95*a*, is connected via a pipe 96 having a relief valve 97 to a second group comprising another plurality of lines 92*a*, 92*b* connected between a feed manifold 95*b* and a discharge manifold 94. This system may be applied, for example, if the grid pressure is 40 bars and the gas is available under higher pressure, for example 80 bars, and it will be observed that this delayed expansion which brings about a frigorific i.e. chilling release does not harm the piping since the natural gas is then in the already partially reheated condition. If applicable, a separator may be situated at the outlet of the release valve 97, which renders it possible to draw off and eliminate the heavier condensates, such as ethane, propane or butane, whilst the gaseous fraction alone is being reheated.

The invention is applicable in particular for the reheating and the revaporization of liquified natural gas.

I claim:

1. A method of reheating a cryogenic fluid by heat exchange with a heat-carrying fluid the freezing point of which is higher than the temperature of said cryogenic fluid prior to its final reheating, comprising introducing the cryogenic fluid into the upper end of a length of vertical tube, passing the cryogenic fluid down through that length of tube and up through another length of vertical tube, removing the reheated cryogenic fluid from the upper end of said another length of tube, and flowing said heat-carrying fluid by gravity from the upper end of and along both of said lengths of tube downwardly by gravity to and beyond the lower ends of said lengths of tube.

2. A method as claimed in claim 1, in which said cryogenic fluid is liquid natural gas.

3. A method as claimed in claim 1, in which said heat-carrying fluid is liquid water.

4. A method as claimed in claim 1, and insulating the heat-carrying fluid from the cryogenic fluid where the heat carrying fluid first contacts the upper end of the first-mentioned length of tube.

5. A method as claimed in claim 4, and increasing the wall thickness of the upper end of the first-mentioned length of tube progressively upwardly in the region where the heat-carrying fluid first contacts the same.

6. Apparatus for reheating a cryogenic fluid by heat exchange with a warm liquid, comprising a tubular heat exchange element in the form of at least two vertical lengths of tube that communicate with each other at their lower ends, means to introduce a cryogenic fluid into the upper end of one of said lengths, means to withdraw the reheated cryogenic fluid from the upper end of the other of said lengths, and means to flow said warm liquid by gravity from the upper ends of both said lengths down along said lengths to and beyond the lower ends thereof.

7. Apparatus as claimed in claim 6, the upper end of said one length being comprised by inner and outer tubes passing down through said inner tube and the warm liquid contacting said outer tube.

8. Apparatus as claimed in claim 7, the wall thickness of said outer tube increasing progressively upwardly in the region of said insulation.

9. Apparatus as claimed in claim 6, said lengths having vertically extending external fins thereon between which said warm liquid flows downwardly by gravity.

10. Apparatus as claimed in claim 6, said lengths together comprising a U-shaped tube.

11. Apparatus as claimed in claim 6, there being a plurality of said one lengths in parallel with each other, in series with a plurality of said other lengths in parallel with each other.

* * * * *